US007926500B2

(12) United States Patent
Perez et al.

(10) Patent No.: US 7,926,500 B2
(45) Date of Patent: Apr. 19, 2011

(54) FRAME STRUCTURE

(75) Inventors: Sam S. Perez, Grimsby (CA); Byron Glaser, Fredericksburg, VA (US)

(73) Assignee: DDF, Inc., Ontario (CA)

( * ) Notice: Subject to any disclaimer, the term of this patent is extended or adjusted under 35 U.S.C. 154(b) by 1502 days.

(21) Appl. No.: 10/902,616

(22) Filed: Jul. 29, 2004

(65) Prior Publication Data

US 2006/0037274 A1 Feb. 23, 2006

(51) Int. Cl.
*E04H 15/40* (2006.01)

(52) U.S. Cl. ..... 135/137; 135/125; 135/135

(58) Field of Classification Search ..... 135/125, 135/132, 134, 135, 137, 147, 159, 116, 120.3; 5/97, 414, 416, 655
See application file for complete search history.

(56) References Cited

U.S. PATENT DOCUMENTS

| | | | | |
|---|---|---|---|---|
| 2,808,846 | A | 10/1957 | Jonsson | |
| 2,948,287 | A | 8/1960 | Rupert | |
| 3,810,482 | A | 5/1974 | Beavers | |
| 4,450,851 | A | 5/1984 | Beavers | |
| 4,627,210 | A * | 12/1986 | Beaulieu | 52/646 |
| 4,637,748 | A * | 1/1987 | Beavers | 403/170 |
| 4,750,509 | A | 6/1988 | Kim | |
| 5,333,634 | A | 8/1994 | Taylor | |
| 5,827,208 | A | 10/1998 | Mason et al. | |
| D412,943 | S | 8/1999 | Oren et al. | |
| 5,930,854 | A * | 8/1999 | O'Neill et al. | 5/655 |
| 6,443,794 | B2 | 9/2002 | Oren et al. | |
| 6,467,107 | B1 * | 10/2002 | Glover et al. | 5/99.1 |
| 7,037,170 | B2 * | 5/2006 | Pacella et al. | 446/268 |
| 7,040,585 | B2 * | 5/2006 | Cheng et al. | 248/200 |
| 7,096,874 | B2 * | 8/2006 | Forshpan | 135/96 |
| 7,376,993 | B2 * | 5/2008 | Myers et al. | 5/655 |
| 2004/0099301 | A1 | 5/2004 | Zhang et al. | |
| 2004/0224823 | A1 * | 11/2004 | Myers et al. | 482/35 |
| 2004/0266312 | A1 * | 12/2004 | Oren et al. | 446/227 |
| 2005/0172411 | A1 * | 8/2005 | Snedeker | 5/655 |
| 2009/0114260 | A1 * | 5/2009 | Knipschild | 135/137 |

FOREIGN PATENT DOCUMENTS

| | | |
|---|---|---|
| CA | 2022870 | 3/1991 |
| EP | 0413507 A1 | 2/1991 |

OTHER PUBLICATIONS

An unknown, undated document.

* cited by examiner

*Primary Examiner* — David Dunn
*Assistant Examiner* — Noah Chandler Hawk
(74) *Attorney, Agent, or Firm* — Husch Blackwell LLP

(57) ABSTRACT

A collapsible free-standing frame structure includes N bowable resilient legs, where N is an integer greater than one, a multi-hinge, and a leg restraint. The multi-hinge includes a hinge body and N leg interconnectors for interconnecting the legs to the hinge body. The leg interconnectors are pivotally mounted to the hinge body for limited pivotal motion between closed positions, in which the interconnected legs are clustered around a central axis which extends through the hinge body, and open positions, in which the interconnected legs extend radially relative to the central axis. A pivot stop prevents the leg interconnectors from pivoting beyond the open positions. To erect the frame structure, the leg interconnectors are pivoted to their open positions, the interconnected legs are bowed against the pivot stop, and the distal ends of the bowed legs are attached to a leg restraint which maintains the legs in the bowed position.

17 Claims, 8 Drawing Sheets

FRAME STRUCTURE

FIELD OF THE INVENTION

The present invention relates to frame structures, and more particularly to free-standing collapsible frame structures.

BACKGROUND OF THE INVENTION

Free-standing collapsible frame structures are well known. For example, various types of free-standing collapsible frame structures are known, such as those having a dome or A-frame shape and which when erected, can be used to support tents.

Free standing collapsible structures may also be used to support infant's toys such as beads, rattles and mirrors within reach of an infant for purposes of promoting infant activity and improving babies' hand-eye coordination.

For example, one known device suspends toys within the reach of an infant in a supine position from an overhead frame consisting of a crossed pair of arches. The device is comprised of a square cloth mat having pockets in each of its four corners suitable for receiving one end of an arch. The arches may be fiberglass rods housed within a cloth sleeve. The tension supplied by the bowed arches has the effect of making taut the cloth mat. When the arches are raised so as to cross each other diagonally over the center of the mat and attached to one another at their cross point with a snap or similar connector, a free-standing frame structure results. Beads, rattles, and other dangling toys may then be clipped to the arches, whose cloth sleeves may have holes or loops to facilitate attachment. Babies may thus lie on their backs on the mat and play with the toys dangling from the frame overhead.

When it is desired to collapse the known device for storage, one of a number of collapsing techniques may be used. In one technique, the arches may be detached from one another at their cross point and folded flat against the mat, so as to collapse device into a secondary single plane. The ends of the arches may be left in the corner pockets of the mat, with the struts remaining bowed. In this position the device still has a footprint that is as large as the mat itself, as the bowed struts continue to apply tension to all four corners of the mat. This large footprint has drawbacks for storage of the device.

In another technique, it is possible to fold the mat in half in a direction away from the arches and to lock the mat in this folded position using snaps at the corners of the mat, with the ends of the struts still in the corner pockets of the mat. This serves to reduce the footprint of the device, however the footprint may still be undesirably large.

In another alternative, the ends of the arches may be removed from the corner pockets to further reduce the storage profile of the device. In this case, the struts may "unbow" to resume their original (straight) form, and the now fully detached mat may be folded or rolled up around the unbowed struts. Although this will reduce the footprint of the mat, the length of the unbowed struts may complicate storage.

An alternative collapsible frame structure, that can be useful for example for supporting infant toys would therefore be desirable.

SUMMARY OF THE INVENTION

A collapsible free-standing frame structure includes N bowable resilient legs, where N is an integer greater than one, a multi-hinge, and a leg restraint. The multi-hinge may include a hinge body and N leg interconnectors for interconnecting the legs to the hinge body. The leg interconnectors can be pivotally mounted to the hinge body for limited pivotal motion between closed positions, in which the interconnected legs are clustered around a central axis which extends through the hinge body, and open positions, in which the interconnected legs extend radially relative to the central axis. A pivot stop can be provided to prevent the leg interconnectors from pivoting beyond the open positions. To erect the frame structure, the leg interconnectors can be pivoted to their open positions, the interconnected legs can then be bowed against the pivot stop, and the distal ends of the bowed legs can be attached to a leg restraint which maintains the legs in the bowed position.

In an exemplary embodiment, N is four, and the four leg interconnectors are evenly spaced about the hinge body of the multi-hinge. When the frame structure of such an embodiment is erected, it has the appearance of a pair of crossed arches.

In accordance with another aspect of the present invention there is provided a collapsible free-standing frame structure, comprising: N bowable resilient legs having pivot attachment end portions and opposite distal end portions, where N is an integer greater than one; a multi-hinge comprising a hinge body, N leg interconnectors for pivotally interconnecting the N bowable resilient legs proximate the attachment end portions to the hinge body, the N leg interconnectors being pivotally mounted to the hinge body for limited pivotal motion between closed positions, in which the interconnected legs are clustered around a central longitudinal axis which extends through the hinge body, and open positions, in which the interconnected legs extend radially relative to the central axis, each of the leg interconnectors being pivotable at the attachment end portions about a leg axis extending transversely of, and being spaced from, the central axis, and further comprising a pivot stop for preventing the leg interconnectors from pivoting beyond the open positions; and a leg restraint for releasable attachment to the distal ends of the N bowable resilient legs, the frame structure having a collapsed position wherein the leg interconnectors are in the closed positions, the frame structure further having an erected position in which the leg interconnectors are in the open positions and the interconnected legs are bowed against the pivot stop and the distal ends of the N bowed legs are attached to the leg restraint so as to maintain the legs in the bowed position.

In accordance with another aspect of the present invention there is provided a multi-hinge for use in a collapsible free-standing frame structure, comprising: a hinge body; N leg interconnectors for interconnecting N bowable resilient legs to said hinge body, said N leg interconnectors being pivotally mounted to said hinge body for limited pivotal motion between closed positions, in which the interconnected legs are clustered around a central longitudinal axis which extends through said hinge body, and open positions, in which the interconnected legs extend radially relative to said central axis, each of said leg interconnectors being pivotable about a leg axis extending transversely of, and being spaced from, said central axis; and a pivot stop for preventing said leg interconnectors from pivoting beyond said open positions.

In accordance with another aspect of the present invention there is provided a A collapsible frame structure comprising: N legs, where N is an integer greater than one, the legs being deformable between a first generally linear configuration and a second generally arched configuration, the legs each also being pivotable about a pivot location located proximate respective attachment end portions of each of the legs, between: (a) a first orientation such that when the N legs are in the first configuration the legs are generally positioned in a parallel relation to each other about a longitudinal axis and are oriented generally in a first longitudinal direction; and (b) a second orientation such that when the N legs are in the second configuration the legs are generally positioned in a non-parallel relation to each other about the longitudinal axis such that when each of the N legs is in the second orientation and each of the N legs is in the second configuration, the frame structure is freely supported on the N legs.

In accordance with another aspect of the present invention there is provided a A collapsible free-standing frame structure kit, comprising: a) a frame structure device comprising i) N bowable resilient legs, where N is an integer greater than one; ii) a multi-hinge comprising a hinge body, N leg interconnectors for interconnecting the N bowable resilient legs to the hinge body, the N leg interconnectors being pivotally mounted to the hinge body for limited pivotal motion between closed positions, in which the interconnected legs are clustered around a central axis which extends through the hinge body, and open positions, in which the interconnected legs extend radially relative to the central axis, each of the leg interconnectors being pivotable about a leg axis extending transversely of, and being spaced from, the central axis, and a pivot stop for preventing the leg interconnectors from pivoting beyond the open positions; and b) a leg restraint for releasable attachment to distal ends of the N bowable resilient legs, the legs of the frame structure device [having] movable between a collapsed position wherein the leg interconnectors are in the closed positions, and an erected position in which the leg interconnectors can be placed in the open positions and the interconnected legs can be bowed against the pivot stop and the distal ends of the N bowed legs can be attached to the leg restraint so as to maintain the legs in the bowed position.

In accordance with another aspect of the present invention there is provided a A method of erecting a collapsible frame structure, the frame structure comprising: N legs each having an attachment end portion and a distal end portion, where N is an integer greater than one, the legs being deformable between a first generally linear configuration and a second generally arched configuration, the legs also each being pivotable about a respective pivot location located proximate the attachment end portions of each of the legs, between: a) a first orientation such that when the N legs are also in the first configuration the legs are generally positioned in a parallel relation to each other about a longitudinal axis, each the N legs having the distal end portions oriented generally in a first common longitudinal direction; and b) a second orientation such that when the legs are in the second configuration the legs are generally oriented in non-parallel relation to each other about the longitudinal axis; the method comprising: i) pivoting each of the N legs about the respective pivot locations from the first orientation to the second orientation; and ii) deforming each of the legs from the first generally linear configuration to the second generally arched configuration.

In accordance with yet another aspect of the present invention there is provided a A frame structure comprising: N legs each having an attachment end and a distal end, where N is an integer greater than one, the legs being deformable between a first generally linear configuration and a second generally arched configuration, the N legs also each being pivotable about a respective pivot location located proximate the attachment ends of each of the legs, between: a) a first orientation such that when the N legs are in the first configuration the legs are generally positioned in a parallel relation to each other about a longitudinal axis, each the legs having the distal ends oriented generally in a first longitudinal direction; and b) a second orientation such that when the legs are in the second configuration the legs are generally oriented in non-parallel relation to each other about the longitudinal axis; the frame structure being operable such that the legs can be pivoted about the pivot location from the first orientation to the second orientation and each of the legs can be deformed from the first generally linear configuration to the second generally arched configuration and such that the legs are oriented generally in a longitudinal direction that is opposite to the first longitudinal direction, so as to support the frame structure on the legs.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In the figures which illustrate by way of example only an embodiment of this invention.

DETAILED DESCRIPTION

Figure 1:
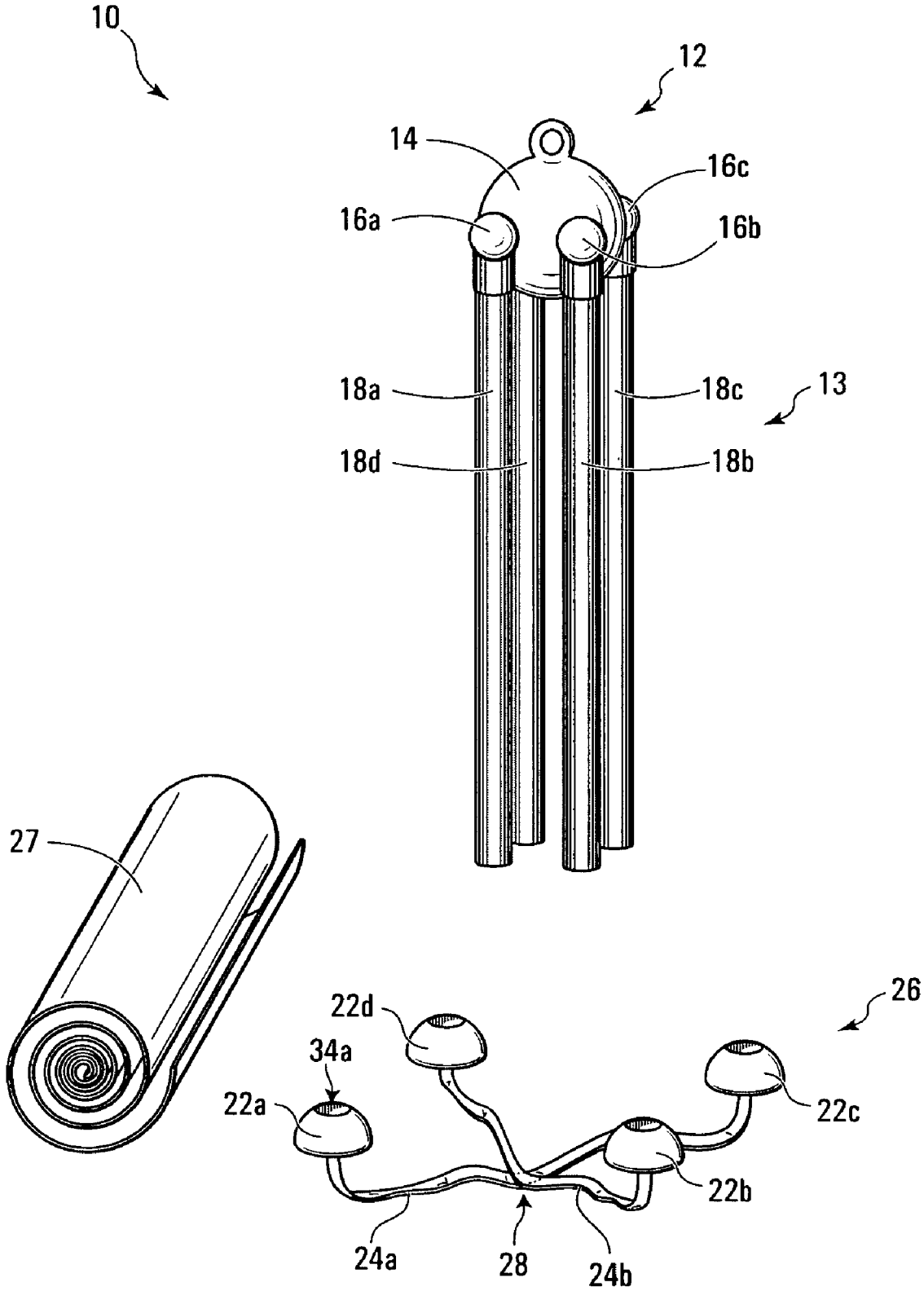
FIG. 1 is a perspective view of a collapsible free-standing frame structure shown in a collapsed position.

FIG. 1 illustrates a collapsible free-standing frame structure 10 and a mat 27. Frame structure 10 has a collapsed position which provides a compact profile for storage and an erected position in which the structure 10 may be used to support one or more items such as for example, infant toys. The frame structure could also be used in a wide variety of other applications such as supporting a web of material to be used for a tent or the like.

The collapsed position of frame structure 10 is shown in FIG. 1. The erected position is shown in FIGS. 7 and 8, which will be described subsequently.

As shown in FIG. 1, the frame structure 10 has two primary components, namely, a collapsible frame 13 and a leg restraint 26.

Figure 7:
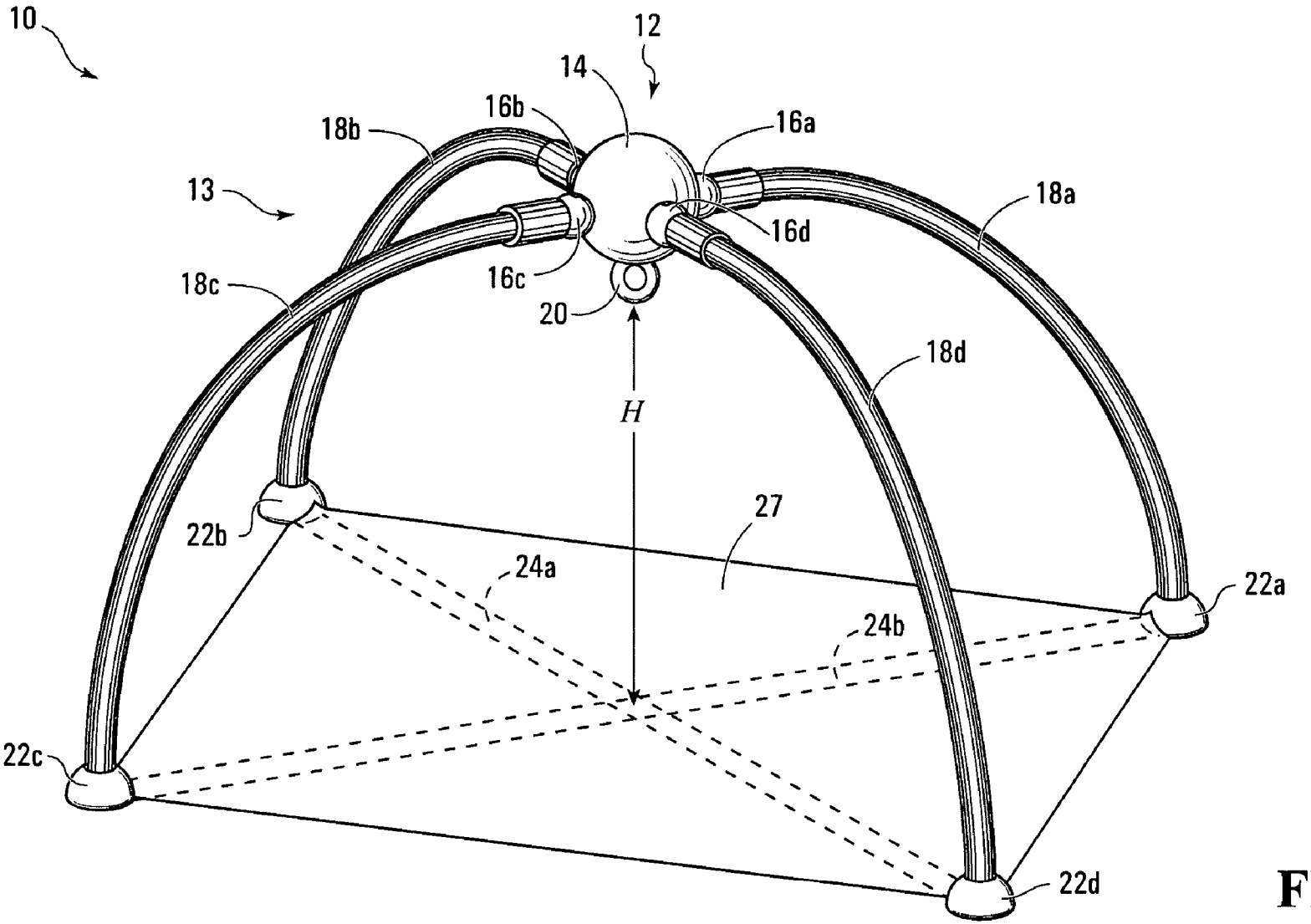
FIG. 7 is a perspective view of the frame structure of FIG. 1 shown in an erected position.
Figure 8:
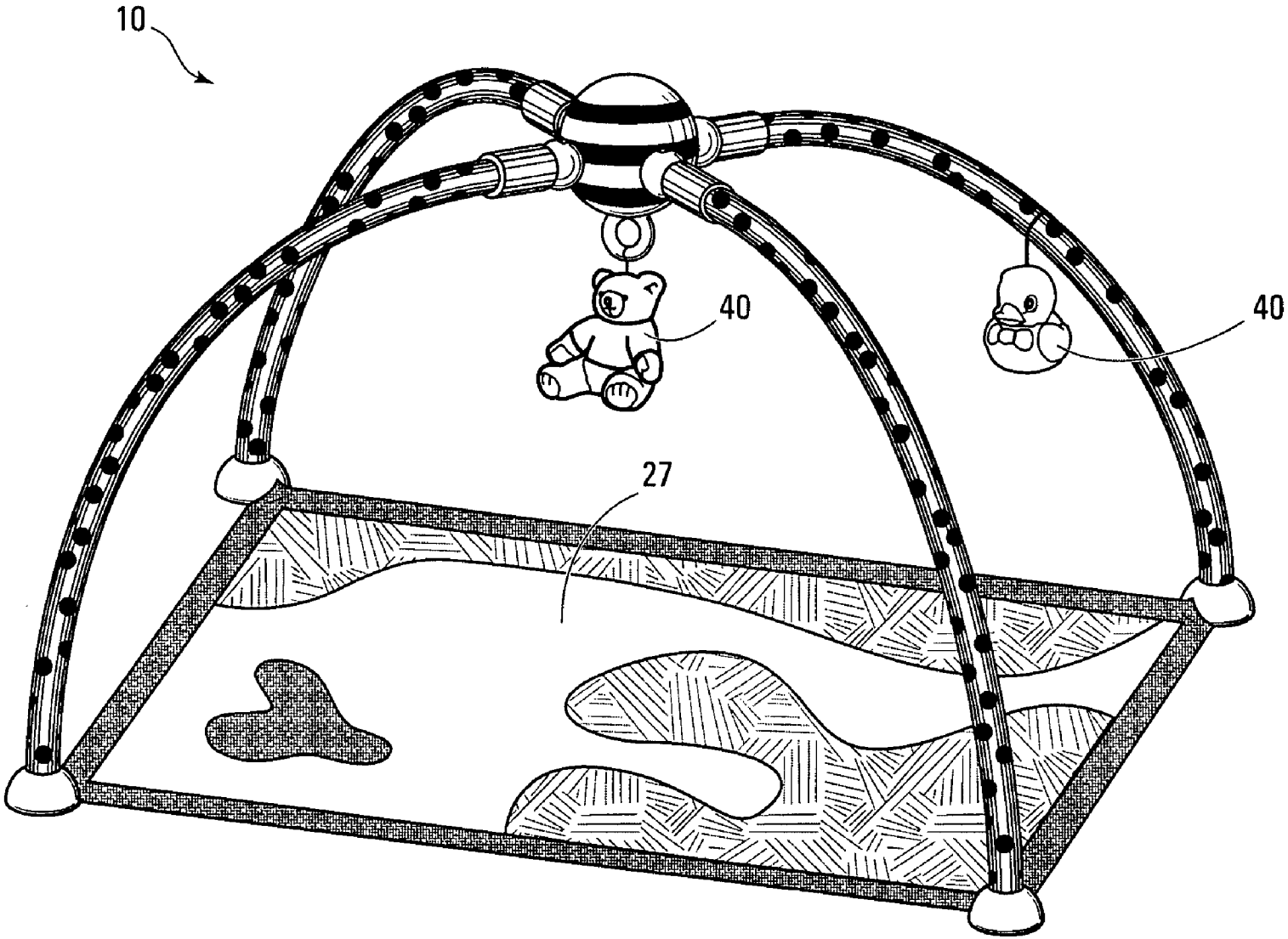
FIG. 8 is a perspective view of the frame structure of FIG. 1 shown in an erected position with infant toys attached thereto.

Collapsible frame 13 is formed into arches when the structure 10 is in the erected position (see FIGS. 7 and 8). Collapsible frame 13 consists of four legs 18*a*, 18*b*, 18*c*, and 18*d* (generically leg(s) 18) connected generally proximate to attachment ends thereof, to a common multi-hinge mechanism 12. The legs 18 can be made of cylindrical lengths of closed cell polyethylene foam, which may be the same material used to make so-called "pool noodle" floatation devices. The legs 18 are accordingly bowable (i.e. can be deformed into the shape of a bow) and may be resilient (i.e. when displaced from an initial position, a restoring force created which tends to force the leg, back towards its undeformed, initial position). Polyethylene foam material is also soft, which advantageously reduces the risk of injury to infants who may bump into one of the legs 18 of the erected structure 10. The multi-hinge 12 consists of a hinge body 14 which can be generally spherical in shape and has four leg interconnectors 16*a*, 16*b*, 16*c*, and 16*d* (generically leg interconnector(s) 16) which interconnect an attachment end portion of each of legs 18*a*, 18*b*, 18*c*, and 18*d*, to the hinge body 14. As will be described, the leg interconnectors 16 have longitudinal axes Ya-Yd (FIGS. 2 and 3) and are configured to be able to pivot about pivot locations in relation to the hinge body 14, allowing the legs 18 to be pivoted from closed positions (shown in FIG. 1) to open positions in which the legs radiate outwardly from the hinge body 14.

In this embodiment leg restraint 26 consists of a set of four feet 22*a*, 22*b*, 22*c*, and 22*d* (generically feet 22 or foot 22) interconnected by a pair of connecting members which may be flexible or semi-flexible straps such as nylon straps 24*a* and 24*b* (generically strap(s) 24). Leg restraint 26 serves to counteract the restoring force created by the bowing of legs 18 so as to maintain the legs 18 bowed in the form of arches when the frame structure 10 is in the erected position by preventing separation of the distal ends of opposing ones of bowed legs 18. Each foot 22 can be formed as a plastic hemisphere with a cylindrical bore in its spherical face (see, e.g., bore 34*a* of foot 22*a*). The bore in each foot 22 is sized for receiving and holding a distal end of a corresponding leg 18. The flat side of the hemisphere, which may by way of example only, have a diameter of approximately 4 inches, is for resting upon the surface on which the erected arch structure 10 is placed (typically the floor). Each strap 24 of the present embodiment interconnects two diagonally opposing feet. Strap 24*a* interconnects feet 22*b* and 22*d* while strap 24*b* interconnects feet 22*a* and 22*c*. The straps 24 can be sewn or otherwise connected together at a cross point 28 near the middle of the length of each strap 24.

Also illustrated in FIG. 1 is a square, padded mat 27, which is shown rolled up for storage. The mat 27, which may be made from cloth, can be used to provide a comfortable surface upon which an infant using the erected frame structure 10 may lie.

Figure 2:
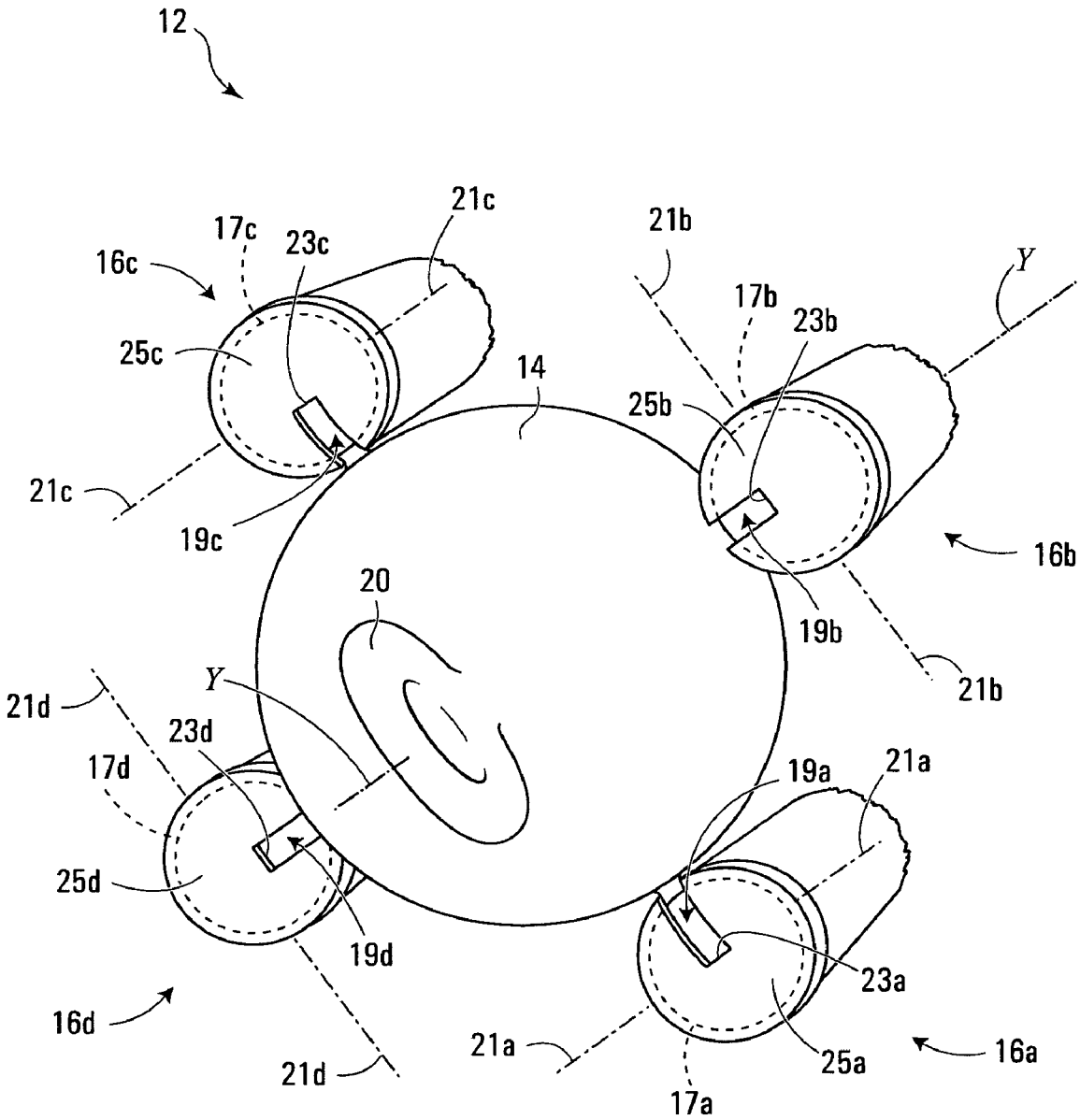
FIG. 2 is an enlarged perspective view of the multi-hinge component of the structure of FIG. 1.
Figure 3:
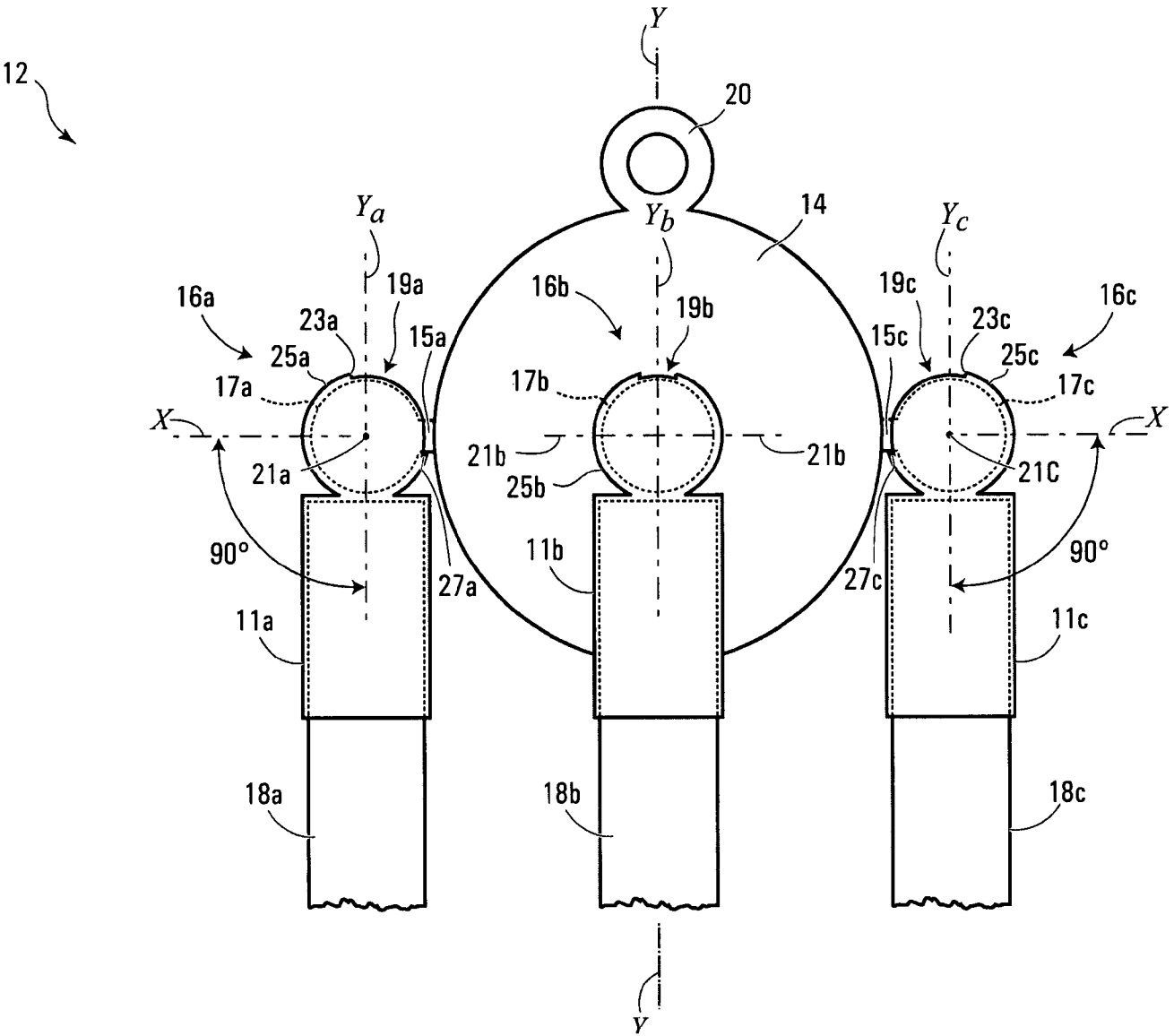
FIG. 3 is a side view of the multi-hinge component of FIG. 2 showing the legs of the frame structure in their closed positions.
Figure 4:
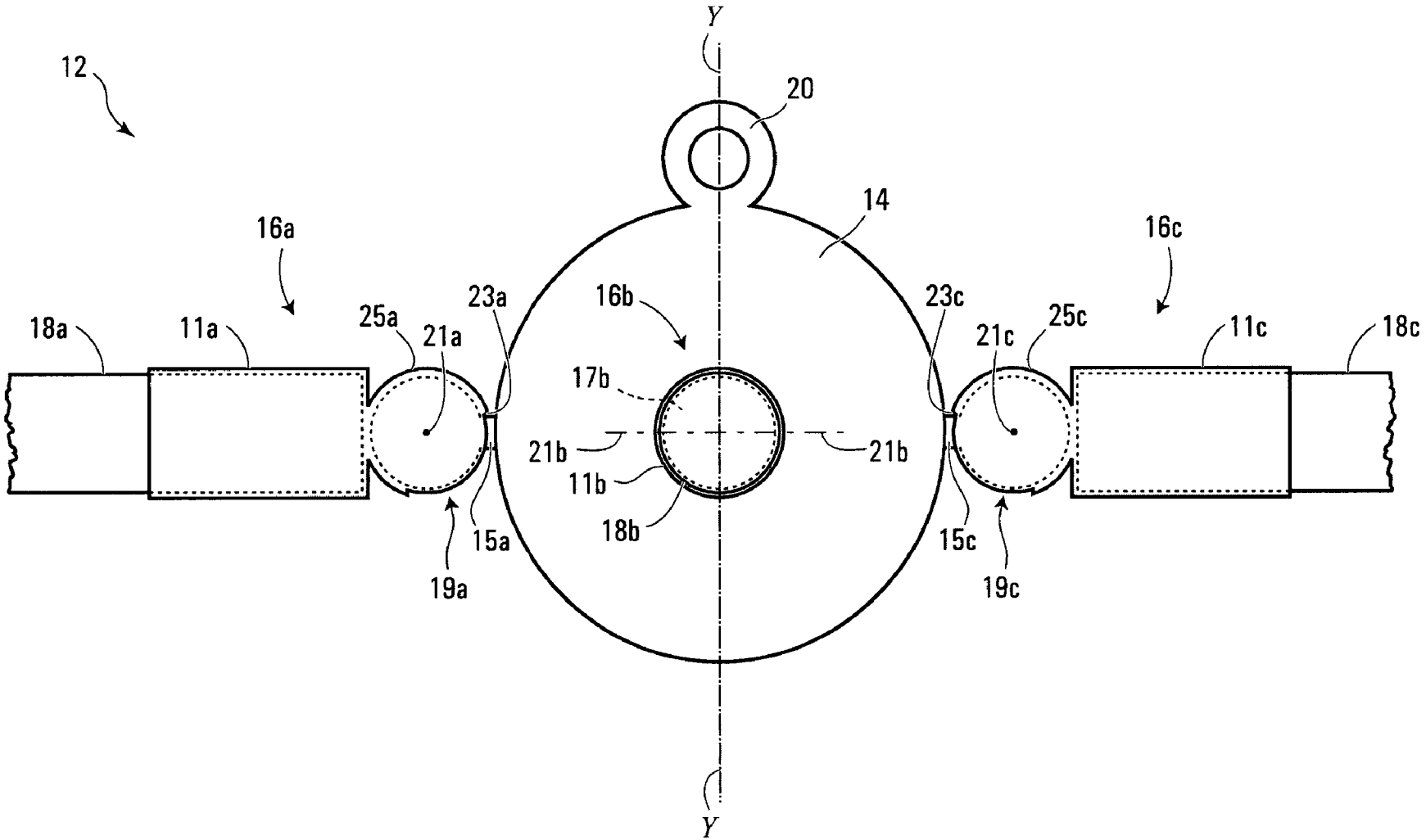
FIG. 4 is a side view of the multi-hinge component of the FIG. 2 showing the legs of the frame structure in their open positions.

FIGS. 2 to 4 illustrate the multi-hinge 12 in greater detail. Referring to FIGS. 2 and 3, multi-hinge 12 is shown with leg interconnectors 16 in closed generally vertically longitudinally oriented positions. The closed positions of leg interconnectors 16 are achieved when the frame structure 10 is in the collapsed position, as shown in FIG. 1. That is, the leg interconnectors 16 are in their closed positions when the interconnected legs 18 are in their closed positions.

As best seen in FIG. 3, each leg interconnector 16*a*, 16*b*, 16*c* and 16*d* consists of a capped cylindrical tube 11*a*, 11*b*, 11*c* and 11*d* (generically tube(s) 11) with an integral ball socket 25*a*, 25*b*, 25*c* and 25*d* (generically ball socket(s) 25), respectively, at its capped end. The cylindrical tube 11 has an opening that is sized to receive one end of a corresponding leg 18 for fixed attachment thereto. Attachment between interconnectors 16 and legs 18 may be by conventional attachment mechanisms such as by way of example, adhesives, and mechanical connections. Each ball socket 25*a*, 25*b*, 25*c* and 25*d* is designed to receive a corresponding ball 17*a*, 17*b*, 17*c* or 17*d* (generically ball(s) 17) so as to form a ball and socket pivot. The balls 17*a*, 17*b*, 17*c* and 17*d* are mounted to or integrally formed with hinge body 14 by way of necks (i.e. mounts) 15*a*, 15*b*, 15*c* and 15*d* respectively (generically neck (s) 15), and which can be circular or of another shape in cross section. The balls 17 can be equally spaced about the spherical hinge body 14 with their centers lying in a common horizontal plane passing though common horizontal axis X that also passes through the center of hinge body 14. It is noted that leg interconnector 16*d*, ball 17*d*, and neck 15*d* are obstructed from view in FIG. 3.

As shown in FIGS. 2 and 3, each ball socket 25*a*, 25*b*, 25*c* and 25*d* has a slot 19*a*, 19*b*, 19*c* and 19*d* (generically slot(s) 19) through which the corresponding neck 15*a*, 15*b*, 15*c* and 15*d* of balls 17 extend. The width of each slot 19 is slightly larger than the diameter or width of the neck 15 which passes therethrough. Pivoting of leg interconnectors 16 is achieved by rotation of the ball sockets 25 about the nested balls 17. In this embodiment, the direction of pivoting rotation of the ball sockets 25 about a central pivot point is dictated by the orientation of slots 19 within which necks 15 travel. The length of the slots 19 are chosen so as to limit the pivoting of leg interconnectors 16 to approximately a 90 degree arc.

Each leg interconnector 16*a*, 16*b*, 16*c* and 16*d* pivots about a respective leg axis 21*a*, 21*b*, 21*c*, and 21*d* (see FIG. 3, noting that leg axis 21*d* is obstructed from view. Leg axes 21*a*, 21*b*, 21*c*, and 21*d* are referred to generically as leg axes 21 or leg axis 21). The leg axes 21 extend transversely of, and are spaced from, a central longitudinal axis Y which extends vertically through the center of hinge body 14. Leg axes 21 are oriented substantially orthogonal to axis Y. Central vertical axis Y is an axis about which the legs 18 are clustered and oriented generally in parallel alignment thereto, when in their closed positions (see FIG. 3). When the leg interconnectors 16*a*, 16*b*, 16*c*, and 16*d* are in their closed positions, their longitudinal axes Ya-Yd are generally oriented parallel to axis Y and are oriented longitudinally in a direction downwards from ring 20. In this configuration, the ends 27*a*, 27*b*, 27*c*, and 27*d* of slots 19 abut necks 15*a*, 15*b*, 15*c* and 15*c* so as to preclude further pivoting in the longitudinal direction, and towards ring 20. However, it will be appreciated that other mechanisms can be employed to provide a desired pivoting movement.

FIG. 4 illustrates the multi-hinge 12 with the leg interconnectors 16 (and interconnected legs 18) in open positions. When the leg interconnectors 16 are in their open positions, the legs 18 radiate outwardly from the hinge body 14. In this position, the ends 23*a*, 23*b*, 23*c*, and 23*d* (generically end(s) 23) of slots 19 abut necks 15*a*, 15*b*, 15*c* and 15*c*. The slot ends 23 and necks 15 thus cumulatively form a pivot stop which prevents the leg interconnectors 16 from pivoting beyond their open positions.

Also clearly shown in FIGS. 2 to 4 is ring 20, which can be integrally formed as part of the hinge body 14. Ring 20 may serve as a point of attachment for an infant toy when the frame structure 10 is in the erected position. When the frame structure is in the collapsed position, the ring may provide a convenient member to assist in carrying the frame.

Figure 5:
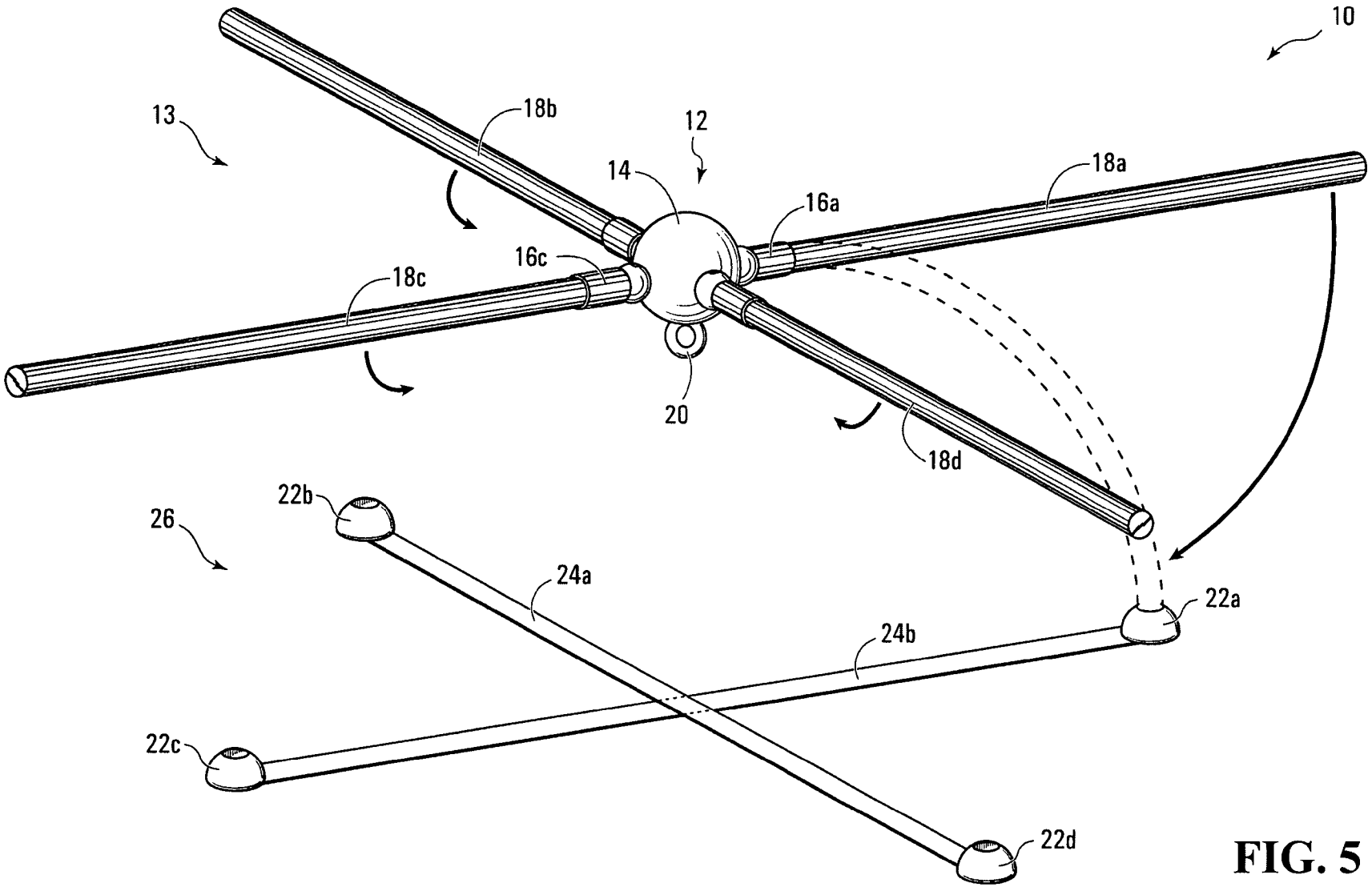
FIG. 5 is a perspective view illustrating the frame structure embodiment of FIG. 1 in a partially erected state.

A method for erection of the frame structure 10 is illustrated in FIGS. 5 to 8. Initially, the leg restraint 26 is laid out on the floor as shown in FIG. 5, with straps 24 being laid flat on the floor in a cross formation. The collapsible frame 13 is inverted from the orientation shown in FIGS. 1, 3 and 4, so that the ring 20 points downwardly towards leg restraint 26. The legs 18 are then pivoted about the pivot axes 21*a*-21*d* respectively at the pivot locations formed by the ball 12 and socket 25 pivots, from their closed positions (shown in FIG. 1) to their open positions in which the legs 18 have been pivoted about 90° from the closed position and radiate outwardly from the hinge body 14 (as shown in FIG. 5).

Figure 6:
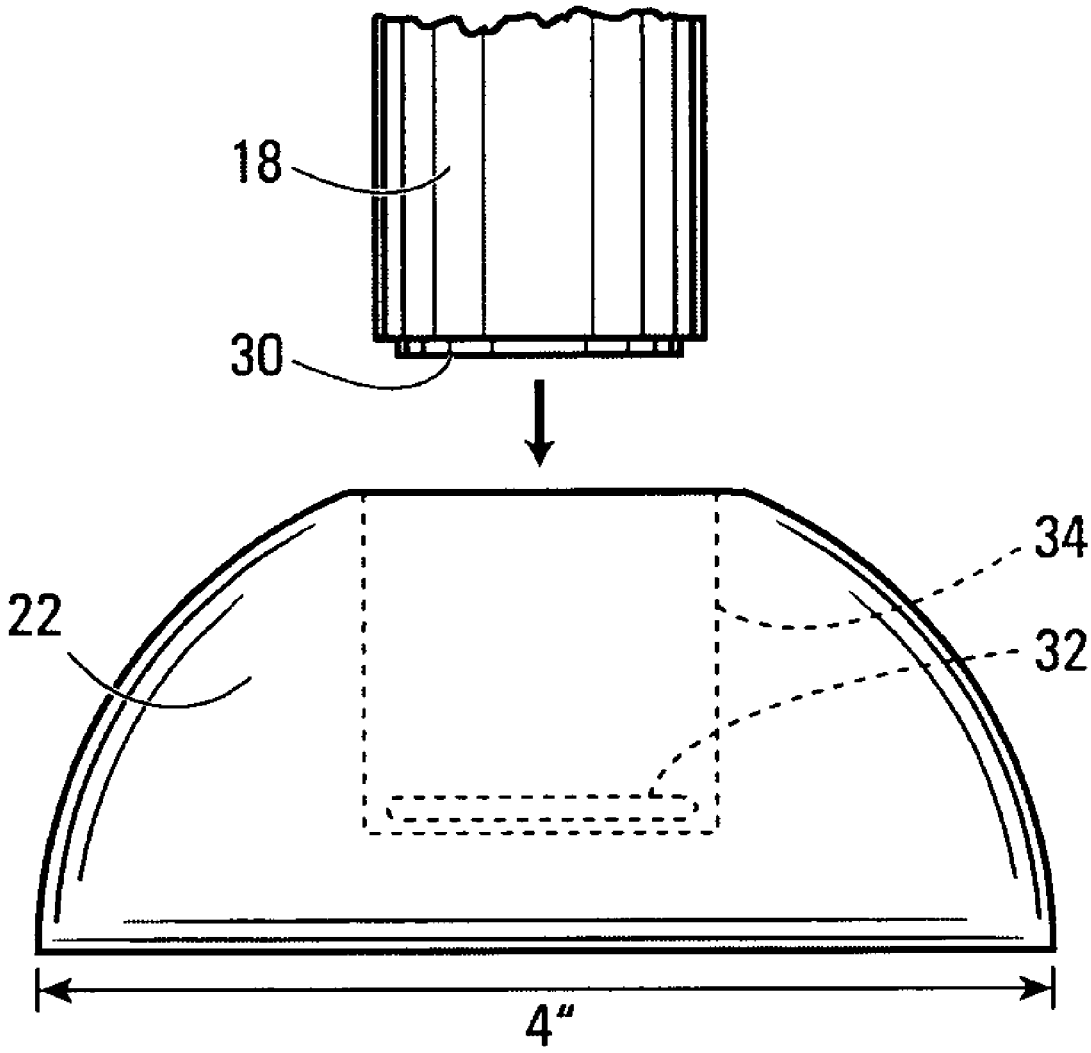
FIG. 6 is a close up side view of one of the feet of the collapsible free-standing structure of FIG. 1.

Either during the pivoting rotation, or thereafter, a first leg 18 is bowed by application of a suitable external force to counteract the resilience of the leg, and its distal end inserted into a corresponding foot 22*a* (see FIGS. 5 and 6). As best illustrated in FIG. 6, the distal end of the leg 18 is inserted snugly within the bore 34 of the foot 22. To secure the leg 18 within the foot 22, one half 30 of a hook-and-loop fastener (e.g. Velcro®), which is sewn to the end of leg 18, can be pressed against a complementary half 32 of the hook-and-loop fastener, which may be glued to the bottom of bore 34.

This process is repeated for each of the remaining three legs 18. If more than one person is involved in erecting the frame structure 10, more than leg 18 can more easily be pivoted and re-configured at the same time. Once all the legs have been pivoted to their open positions, and bowed to their generally arched configuration (which in the illustrated embodiment is curvillear), the result is an erected frame structure 10 as shown in FIG. 7. In the erected position, the collapsible frame 13 portion of frame structure 10 has the appearance of a pair of crossed arches. The flexed legs 18 have forces in them tending to move the legs to a straightened configuration but are maintained in their bowed positions by the leg restraint 26, whose straps 24 apply tension between opposing feet 22 to prevent the distal ends of opposing ones of legs 18 from separating. At the hinge body 14, further downward pivoting of the leg interconnectors 16 about the pivot locations towards ring 20 is prevented by the abutment of the ends 23 of slots 19 against necks 15 (as shown in FIG. 4). The leg interconnectors 16 are thus maintained in their open positions despite the downward rotational force applied thereto by the bowed legs 18. When the frame structure 10 is erected, the height of the ring 20 from the floor may be approximately 20 inches for an infant toy support. Thus in this embodiment, frame structure 10 can be freely supported on the legs 18.

As shown in FIG. 7, mat 27 is then spread out over the straps 24 to provide a comfortable surface upon which an infant using the frame structure 10 may lie. When infant toys 40 are attached to the ring 20 and legs 18 (see FIG. 8), the frame structure 10 is ready for use. It is noted that, in FIG. 8, the legs 18, mat 27, and multi-hinge 12 can be decorated with whimsical patterns for the amusement of an infant. To collapse the erected frame structure 10, the process illustrated in FIGS. 5 to 8 can be reversed. When collapsing of the frame structure 10 is complete, the structure will have the appearance shown in FIG. 1. Infant toys 40 may be left attached to the collapsible frame 13 for convenience. As will be appreciated by those skilled in the art, modifications to the above-described embodiment can be made without departing from the essence of the invention. For example, it is not necessary for the number of legs 18 to be four. Alternative embodiments may have a lesser or greater number of legs, provided that the number of legs is at least two. In such alternative embodiments, the number of leg interconnectors 16 in multi-hinge 12 can be selected to match the number of legs 18. If the number of legs is only two, it may be necessary for leg restraint 26 to be adapted to provide added support to the legs 18 at their distal ends to prevent the arch formed by the opposing legs from toppling when an infant tugs on a toy attached thereto. If the number of legs is odd, it will be appreciated that the "half-arch" formed by a single bowed leg may not be directly opposite another "half-arch" when the frame structure 10 is erected (assuming that the legs are evenly spaced about the multi-hinge 12). Although the frame structure can be configured with more than four legs, if the number of legs is more than four, certain disadvantages may result. For example, the storage profile of the collapsed frame structure 10 may be undesirably increased, and accessibility to the mat 27 of the erected frame structure 10 may be decreased. Depending upon the number of legs in the embodiment, it may be desirable to modify the shape of mat 27 to be that of a polygon with the same number of vertices as there are legs, such that each vertex of the polygon corresponds to the position of a distal end of a leg when the mat is lain over the leg restraint 26 of the erected frame structure 10.

As well, it will be recognized that use of a "ball and socket" pivot between the leg interconnectors 16 and the hinge body 14 is not necessary. Many other forms of known pivots providing the desired range of motion could be employed. The range of motion provided by these pivots need not be 90 degrees, provided that the legs 18 radiate outwardly when the leg interconnectors 16 are in their open positions. The legs may pivot less than or more than 90 degrees from parallel alignment with the vertical axis. For example the legs can be configured to pivot to an angle that is somewhere in the range of 45 degrees to 135 degrees from the parallel alignment with axis Y. Additionally, it is possible to configure the pivot mechanism such that the amount of pivotal rotation can be varied (ie. The amount of rotation can be selected from at least two different settings to provide for a choice of configurations). However, different strap and mat configurations might also be required.

It will further be appreciated that the leg restraint 26 need not consist of straps 24 interconnecting opposing feet 22. The leg restraint may take other forms. For example, in one variation, each foot 22 may be attached by straps (or other tethers) to its adjacent feet 22 rather than by a single strap to its opposing foot 22. In this variation, the straps of a four-legged embodiment would form a square, with a foot 22 in each corner of the square. In another variation, there may be no need for any straps whatsoever. For example, the feet 22 may be permanently attached directly to the corners of mat 27, with mat 27 serving to tether the feet 22 to each other. In yet another variation, the leg restraint 26 may not have any feet per se. Rather, the distal ends of legs 18 may be attached directly to straps 24 or to the mat 27, e.g., to pockets formed therein, or using connectors such as hook-and-loop connectors or other forms of releasable connector. The specific form of leg restraint 26 is not important as long as the restraint 26 serves to keep the legs 18 of the erected frame structure 10 in their bowed positions, in order to keep the frame structure 10 in its erected position.

If an embodiment does have feet 22, it is not necessary for the feet to be hemispheres. The feet could have various other shapes, such as other (non-hemisphere) types of sphere segments, catenoids, or disks for example. Preferably, each foot should have a wide flat base for stability and should if being used for an infant's toy, lack sharp edges which could pose a risk of injury to an infant.

Additionally, the legs 18 need not be manufactured from closed cell polyethylene foam. They may be made from other bowable resilient materials, such as fiberglass or certain plastics, which may be nested within a cloth sleeve.

Furthermore, it is not necessary that the legs be made of materials which are resilient. For example, it is possible to provide legs which can be deformed from a substantially straight configuration to a substantially bowed or arched configuration by the application of a force, and then will hold in the arched configuration within desired operational limits without a restraining mechanism. For example, the legs could be configured from a series of interconnected leg segments, having detent mechanisms for holding two adjacent leg portions in two different relative positions. Alternately, special materials or combinations of materials such as possibly shape memory materials, which can be deformed from an initial configuration, hold the deformed configuration within operational limits, and then be returned again thereafter to its initial configuration.

Fundamentally, the frame structure 10 may be used for purposes other than supporting infant toys. For example, the frame structure 10 could be used to support a tent or the like.

Other modifications will be apparent to those skilled in the art and, therefore, the invention is defined in the claims.

What is claimed is:

1. A collapsible free-standing frame structure, comprising:

(i) N bowable resilient legs having pivot attachment end portions and opposite distal end portions, where N is an integer greater than one;

(ii) a multi-hinge comprising a hinge body, N leg interconnectors for pivotally interconnecting said N bowable resilient legs proximate said attachment end portions to said hinge body, said N leg interconnectors being pivotally mounted to said hinge body for limited pivotal motion between closed positions, in which the interconnected legs are clustered around a central longitudinal axis which extends through said hinge body, and open positions, in which the interconnected legs extend radially relative to said central axis, each of said leg interconnectors being pivotable at said attachment end portions about a leg axis extending transversely of and being spaced from, said central axis, and further comprising a pivot stop for preventing said leg interconnectors from pivoting beyond said open positions;

said legs being resiliently deformable between a first generally linear configuration and a second generally arched configuration;

said legs each also being pivotable between:

(a) a first orientation such that when said N legs are in said first configuration said legs are generally positioned in a parallel relation to each other about a longitudinal axis and are oriented generally in a first longitudinal direction; and (b) a second orientation such that when said N legs are in said second configuration said legs are generally positioned in a non-parallel relation to each other about said longitudinal axis;

and wherein when each of said N legs is in said second orientation and each of said N legs is in said second configuration, said frame structure is freely supported on said N legs; and wherein when each of said N legs is in said second orientation and each of said N legs is in said second configuration, each of said N legs is oriented generally toward a second longitudinal direction that is opposite to said first longitudinal direction and each of said N legs is also in a generally arched configuration that extends the distal end portions opposite said attachment end portions of said legs concavely away from said first generally longitudinal direction; and a leg restraint for releasable attachment to said distal ends of said N bowable resilient legs, wherein said leg restraint comprises at least one connector interconnecting at least one leg to one other of said legs located opposite to said at least one leg so as resist the forces tending to separate said one leg and said other leg and thereby limit the separation between said one and said other legs so as to maintain said one and said other legs in said second orientation and in said second generally arched configuration;

said frame structure having a collapsed position wherein said leg interconnectors are in said closed positions, said frame structure further having an erected position in which said leg interconnectors are in said open positions and said interconnected legs are bowed against said pivot stop and said distal ends of said N bowed legs are attached to said leg restraint so as to maintain said legs in said second orientation and said second generally arched configuration.

2. The frame structure of claim 1 wherein said connectors comprise N feet for receiving said distal ends of said N bowed legs and said connectors further comprise tethers interconnecting each of said feet to at least one other of said feet so as to limit separation therebetween.

3. The frame structure of claim 2 wherein said tethers interconnect opposing ones of said feet.

4. The frame structure of claim 2 wherein each of said feet comprises a bore for receiving a distal end of one of said bowed legs.

5. The frame structure of claim 2 wherein each of said feet comprises a releasable connector for attaching to a distal end of one of said bowed legs.

6. The frame structure of claim 5 wherein said releasable connector comprises one of a hook portion or a loop portion of a hook-and-loop connector, and wherein said distal end of said bowed leg has permanently attached thereto the other of said hook portion or loop portion of a hook-and-loop connector.

7. The frame structure of claim 1 further comprising a mat for providing a comfortable surface under said frame structure in said erected position.

8. The frame structure of claim 1 wherein N is four.

9. The frame structure of claim 1 wherein said legs are made from closed cell polyethylene foam.

10. The frame structure of claim 1 wherein said multi-hinge is suspended 20 inches above a surface upon which said frame structure is placed when in said erected position.

11. A collapsible frame structure comprising:

(i) N legs, where N is an integer greater than one, said legs being resiliently deformable between a first generally linear configuration and a second generally arched configuration, said legs each also being pivotable about a pivot location located proximate respective attachment end portions of each of said legs, between:

(a) a first orientation such that when said N legs are in said first configuration said legs are generally positioned in a parallel relation to each other about a longitudinal axis and are oriented generally in a first longitudinal direction; and (b) a second orientation such that when said N legs are in said second configuration said legs are generally positioned in a non-parallel relation to each other about said longitudinal axis and wherein when said legs are in said second orientation, said second generally arched configuration extends distal end portions opposite respective said attachment end portions of each of said legs concavely away from said first generally longitudinal direction;

(ii) a leg restraint comprising at least one connector interconnecting at least one of said legs to at least one other of said legs opposite said one leg so as resist the force tending to separate said at least one and said other legs to thereby limit the separation between said one leg and said other of said legs so as to maintain said one and said other legs in said generally arched configuration;

such that when each of said N legs is in said second orientation and each of said N legs is in said second configuration, said frame structure is freely supported on said N legs.

12. The frame as claimed in claim 11 wherein when each of said N legs is in said second orientation and each of said N legs is in said second configuration said N legs are oriented generally toward a second longitudinal direction that is opposite to said first longitudinal direction.

13. A frame structure comprising:

(i) N legs each having an attachment end and a distal end, where N is an integer greater than one, said legs being resiliently deformable between a first generally linear configuration and a second generally arched configuration, said N legs also each being pivotable about a respective pivot location located proximate said attachment ends of each of said legs, between:

a) a first orientation such that when said N legs are in said first configuration said legs are generally positioned in a parallel relation to each other about a longitudinal axis, each of said legs having said distal ends oriented generally in a first longitudinal direction; and b) a second orientation such that when said legs are in said second configuration said legs are generally oriented in non-parallel relation to each other about said longitudinal axis;

(ii) a connector apparatus joining one leg to another leg so as to resist deformation forces tending to separate said one leg and said other leg and thereby limit the separation between said one leg said other leg so as to maintain said one leg and said other leg in said generally arched configuration;

said frame structure being operable such that said legs can be pivoted about said pivot location from said first orientation to said second orientation and each of said legs can be deformed from said first generally linear configuration to said second generally arched configuration and such that said legs are oriented generally in a longitudinal direction that is opposite to said first longitudinal direction, so as to support said frame structure on said legs, and wherein said legs are resiliently deformable between said first configuration and said second configuration and wherein when said legs are in said second orientation, said second generally arched configuration extends the distal ends of said legs concavely away from said first longitudinal direction.

14. A collapsible free-standing frame structure, comprising:

(i) N bowable resilient legs having pivot attachment end portions and opposite distal end portions, where N is an integer greater than one;

(ii) a pivot mechanism for pivotally interconnecting said N bowable resilient legs proximate said attachment end portions to said hinge body, said pivot mechanism permitting pivotal movement of said attachment end portions of each of said N legs between closed positions, in which the interconnected legs are positioned about a longitudinal axis, and open positions in which the interconnected legs extend radially relative to said longitudinal axis;

said N legs being resiliently deformable between a first generally linear configuration and a second generally arched configuration;

said N legs each also being pivotable between:

(a) a first orientation such that when said N legs are in said first configuration said legs are positioned in a generally parallel relation to each other relate to said longitudinal axis and are oriented generally in a first longitudinal direction; and (b) a second orientation such that when said N legs are in said second configuration said legs are positioned in a generally non-parallel relation to each other about said longitudinal axis;

and wherein when each of said N legs is in said second orientation and each of said N legs is in said second configuration, said frame structure is freely supported on said N legs; and wherein when each of said N legs is in said second orientation and each of said N legs is in said second configuration, each of said N legs is oriented generally toward a second longitudinal direction that is opposite to said first longitudinal direction and each of said N legs is also in a generally arched configuration that extends the distal end portions opposite said attachment end portions of said legs concavely away from said first generally longitudinal direction; and a leg restraint for releasable attachment to said legs, wherein said leg restraint comprises at least one connector interconnecting at least one leg to one other of said legs located opposite to said at least one leg so as resist the forces tending to separate said one leg and said other leg and thereby limit the separation between said one and said other legs so as to maintain said one and said other legs in said generally arched second configuration;

said frame structure having a collapsed position wherein said interconnected legs are in said closed positions; said frame structure further having an erected position in which said attachment end portions of each of said N legs are in said open positions and said interconnected legs are bowed and said distal ends of said one and said other legs are attached to said leg restraint so as to maintain said legs in said bowed position.

15. The frame structure of claim 14 wherein N is four.

16. A frame structure as claimed in claim 14 further comprising at least one pivot stop for preventing said attachment end portions of each of said N legs from pivoting beyond said open positions.

17. A frame structure as claimed in claim 16 wherein when said N legs are in said open positions said interconnected legs are bowed against said pivot stop.

* * * * *